United States Patent [19]

Gries

[11] Patent Number: 4,760,391

[45] Date of Patent: Jul. 26, 1988

[54] TRI-STATE ON-SCREEN DISPLAY SYSTEM

[75] Inventor: Robert J. Gries, Indianapolis, Ind.

[73] Assignee: RCA Licensing Corporation, Princeton, N.J.

[21] Appl. No.: 732,865

[22] Filed: May 10, 1985

[51] Int. Cl.[4] ..... G09G 1/14

[52] U.S. Cl. ..... 340/748; 340/730; 340/734; 340/811; 358/183

[58] Field of Search ..... 340/720, 721, 723, 729, 340/730, 732, 793, 805, 811, 813, 734, 748; 358/22, 183, 184

[56] References Cited

U.S. PATENT DOCUMENTS

| | | | |
|---|---|---|---|
| 3,984,828 | 10/1976 | Beyers, Jr. . | |
| 4,218,698 | 8/1980 | Bart et al. | 358/183 |
| 4,432,016 | 2/1984 | Shanley, II et al. | 358/183 |
| 4,437,092 | 3/1984 | Dean et al. | 340/730 |
| 4,459,585 | 7/1984 | Pasternak | 340/720 |

OTHER PUBLICATIONS

Pages 29–31 and 60–61 of "RCA Television Basic Service Data–CTC 131 Series", file 1984, CTC 131, Second Edition, published by RCA Corporation, Indianapolis, Ind.

*Primary Examiner*—Gerald L. Brigance
*Assistant Examiner*—Jeffery A. Brier
*Attorney, Agent, or Firm*—Paul J. Rasmussen; Eugene M. Whitacre; Peter M. Emanuel

[57] ABSTRACT

An on-screen character display system includes a tri-state character generator for generating a tri-state character signal having black portions corresponding to the leading and trailing edging portions of the character and a white portion corresponding to the body of the character and an inactive level when no character is to be displayed. To prevent the shielded cable used for coupling the tri-state character signals to video signal processing circuit from remaining charged to the black level corresponding to the trailing edging portion too long thereby creating a disturbing inequality between the widths of the edging portions, an auxiliary driver circuit is enabled to drive the shielded cable toward the inactive level when the character is supposed to end.

15 Claims, 3 Drawing Sheets

TRI-STATE ON-SCREEN DISPLAY SYSTEM

Figure 1A:
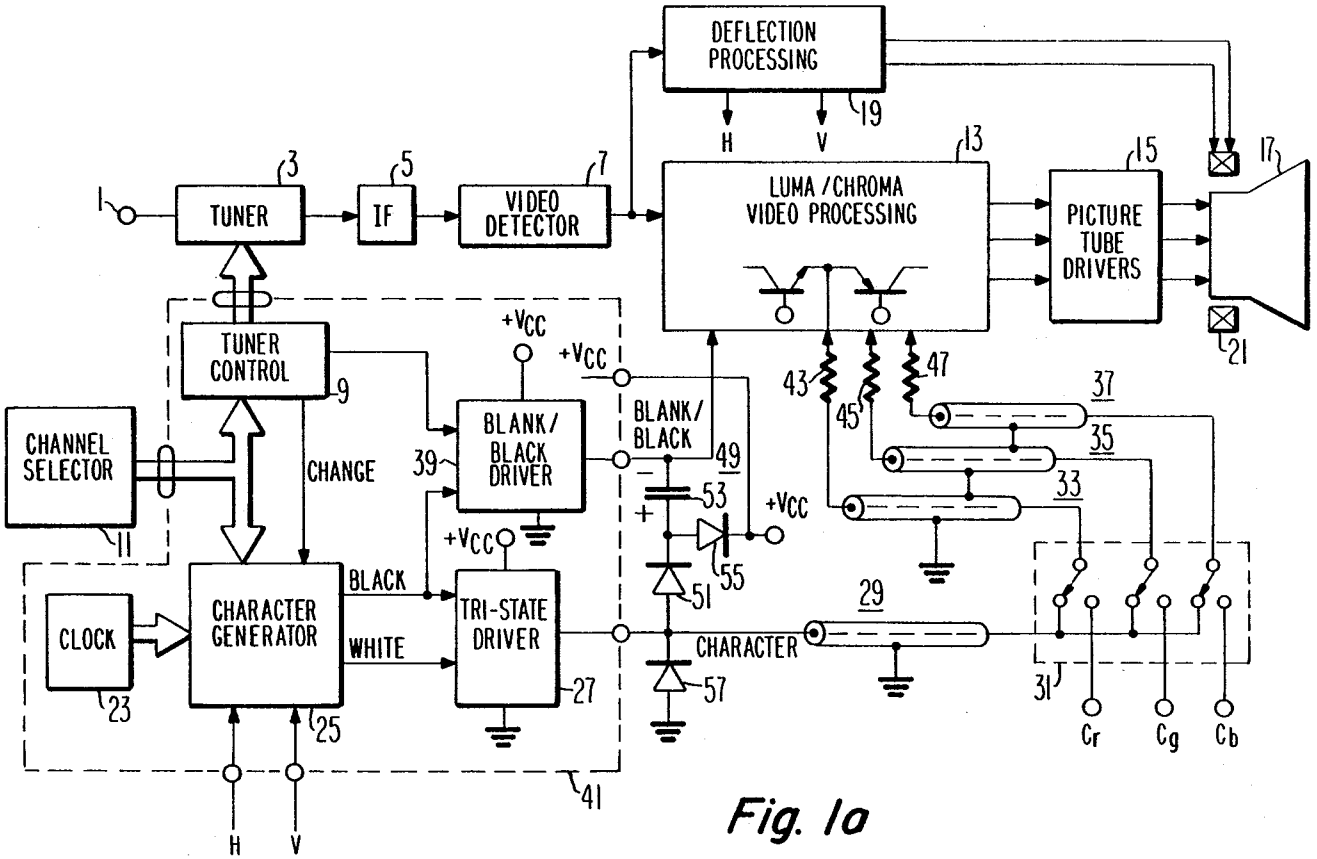

The present invention concerns a tri-state on-screen-display system as may, for example, be employed in a television receiver or monitor.

An on-screen-display (OSD) system generates signals for displaying graphics including alpha-numeric and symbol characters on the screen of a television receiver or monitor. For example in a television receiver, an OSD system may be used to display the selected channel number, the time of day and information for guiding (or "prompting") a user through various operating modes. The characters may be displayed within a normal picture derived from a received television signal or by themselves with the surrounding picture "blanked". The latter type of display may be provided, for example, when it is desired to display a channel number and the time of day during a channel selection process when the tuner of the television receiver is being tuned from one channel to another.

For displaying characters within a picture, some character generators for OSD systems provide "edging" so that the characters may be better distinguished from the background picture. Such a character generator is described in U.S. Pat. No. 3,984,828 issued in the name of B. W. Beyers, Jr. on Oct. 5, 1976. That character generator produces a white signal component for producing the character itself and a black signal component for producing the leading and trailing edging portions.

Character signal components generated by a character generator are typically coupled to the picture tube of the television receiver or monitor through video signal processing circuitry which amplifies and otherwise processes the character signal components to put them in a suitable form for driving the picture tube. In a color television receiver or monitor, a pair of white and black character signal components are coupled to the signal processing circuitry for each electron gun of the picture tube. The black and white character signal components may be coupled to the signal processing circuitry in the form of two separate white and black signals or in the form of a single signal including both white and black signal portions. The latter type of character signal often includes a third, inactive or neutral portion which does not cause either a white or black character portion to be displayed.

Such "tri-state" character signals are advantageous since they require only a single signal conductor per electron gun for coupling the character signal components to the signal processing circuitry. This is of particular importance when the video signal processing circuitry is embodied in an integrated circuit since only one terminal per electron gun is required for OSD purposes. Tri-state character signals are also advantageous since the third or inactive portion may be made to correspond to a high output impedance state of the character generator. This simplifies the circuitry used to combine the character signals with normal video signals for coupling to the picture tube since the high output impedance of the character generator provided in the inactive state does not load the normal video signal paths.

Often shielded cables are employed to couple the character signals from the character generator to the video signal processing circuitry to shield the character signals from interference from radiated signals produced elsewhere in the television receiver or monitor.

Shield cables may present relatively large capacitive loads to the character generators which may degrade the otherwise relatively fast rise and fall times of the transitions of the character signals thereby tending to smear the edges of the characters and associated edging portions. Typically, both the black edging and the white character portions of a tri-state character signal are generated by causing corresponding transistor drivers to be conductive so as to "drive" the character signal to black and white levels. Accordingly, for the most part, the capacitive loading effect of shielded cables in degrading the rise and fall times of the character signals can be compensated for by providing the appropriate amount of drive current to rapidly charge and discharge the capacitive loads provided by the shielded cables. Unfortunately, after the last black edging portion of a tri-state character signal, the character signal is not driven to the inactive level from the black level. Accordingly, the capacitive load exhibited by a shielded cable may remain charged to the black level corresponding to the trailing black edging portion for a relatively long time creating an inequality between the widths of the leading and trailing edging portions.

The inequality of the durations of the leading and trailing edging portions, as well as the degradation of the rise and fall times of the character signal, due to the capacitive loading effect of shielded cables can be minimized by providing relatively low input impedance arrangements in the signal processing circuitry receiving the character signals to enhance the rapid charging and discharging of the capacitive load provided by a shielded cable. A good example of signal processing circuitry with such provisions is described in U.S. Pat. No. 4,432,016 issued in the names of R. L. Shanley, II and R. P. Parker on Feb. 14, 1984. Unfortunately, in some instances, such provisions within the signal processing circuitry may not be sufficient. For example, character generation and signal processing integrated circuits designed for one chassis with a given amount of shielded cable may not be adequate for another in which more shield cable is used. Furthermore, it is often desirable in television receivers and monitors, due to the likelihood of high energy discharges or "arcing" associated with the picture tube, to protect the integrated circuits which may be damaged by such arcing. For this reason, current limiting resistors may be placed in series with the input terminals of an integrated circuit. It is here recognized that when more than anticipated shield cabling is used and/or when current limiting resistors are placed in series with character signal input terminals of an integrated video signal processing circuit, the provisions noted above for compensating for the capacitive loading effect of shielded cables in causing unequal width leading and trailing character edging portions may be hampered to where the difference in duration is very disconcerting to viewers. The present invention is directed to overcoming this difficulty.

According to the present invention, in an on-screen display apparatus employing a tri-state character generator for generating a tri-state character signal having first and second active levels, e.g., corresponding to black and white portions of a character, and an inactive level, an auxiliary driver is provided to drive the character signal toward the inactive level from one of the active levels in response to an auxiliary signal indicating the end of the character.

Figure 1B:
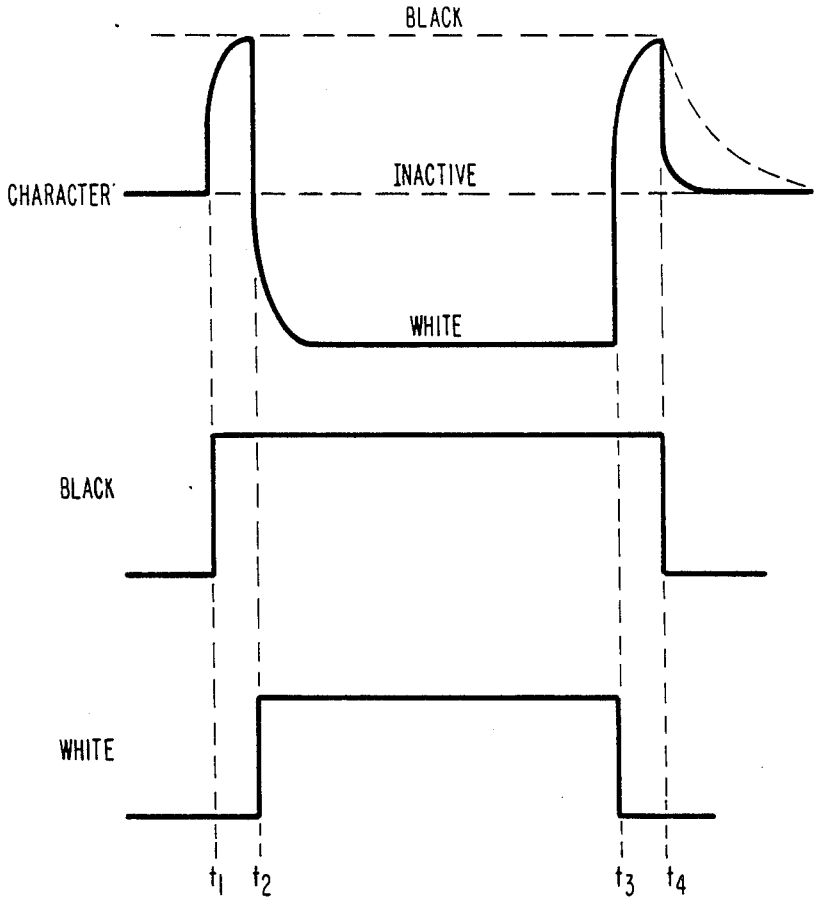
Figure 2:
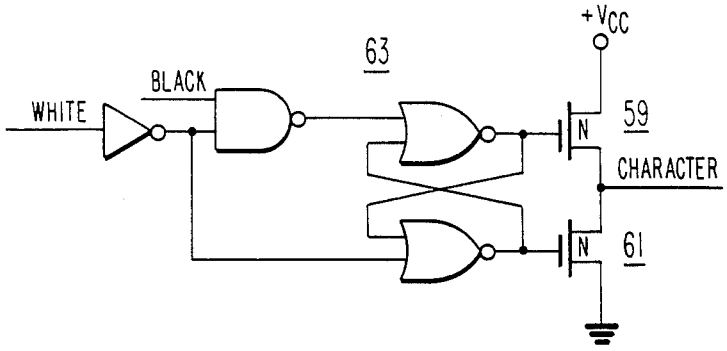
Figure 3:
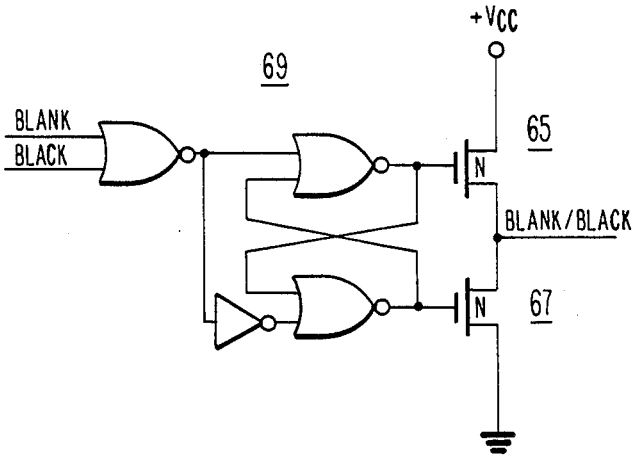

This and other features of the invention will be described in detail with reference to the accompanying Drawing in which:

FIG. 1*a* shows, partly in block form and partly in schematic form, a preferred embodiment of the invention incorporated in a color television receiver/monitor;

FIG. 1*b* shows graphical representations of signal waveforms useful in understanding the preferred embodiment of the invention shown in FIG. 1*a*; and FIGS. 2 and 3 show, in schematic form, implementations of portions of the preferred embodiment shown in block form in FIG. 1*a*.

The color television receiver/monitor shown in FIG. 1*a* includes a conventional arrangement of an RF input 1, a tuner 3, an IF section 5, and a video detector 7 for producing a composite video signal from the one of a plurality of received RF television signals corresponding to a selected channel. Tuner 3 is controlled by a tuning voltage and bandswitching signals generated by a tuner control unit 9 in response to binary signals suitable coded, for example in BCD (binary coded decimal), by a channel selection unit 11 to represent the channel number of the channel selected by a user.

The luminance and chrominance portions of the composite video signal generated by video detector 7 are coupled to a luminance/chrominance video signal processing unit 13 which generates low level red, green and blue (r, g and b) color-representative signals. The r, g and b signals are appropriately amplified in respective drivers within a picture tube driver section 15 to form relatively high level red, green and blue (R, G and B) color-representative signals. The R, G and B signals are coupled to respective electron guns of a picture tube 17. The synchronization components of the composite video signal produced by video detector 7 are coupled to a deflection processing unit 19 which provides horizontal and vertical deflection signals to deflection coils 21 associated with picture tube 17.

The channel number representative signals generated by channel selection unit 11 and coded signals representing the present time (in hours and minutes) generated by a clock unit 23 are coupled to a character generator 25. Character generator 25 generates black and white signals for forming characters with black edging portions on the screen of picture tube 17 indicating the selected channel number and time of day when caused to do so by tuner control unit 9. By way of example, when the channel is changed by means of channel selection unit 11, tuner control unit 9 generates a "change" signal which causes character generator 25 to generate the appropriate black and white signals for producing white numbers with black edging portions on the screen of picture tube 17 corresponding to the selected channel number and the time of day. Character generator 25 receives horizontal and vertical synchronization pulses from deflection processing unit 19 for determining the position of the on-screen characters. The character signals are coupled to video processing unit 13, in tri-state form, as will be explained in detail below, where they are converted to r, g and b type signals for forming the characters on the screen of picture tube 17.

During channel changes, when the video signal provided by video detector 7 is unreliable, the screen, except for the portion displaying the new channel number and time of day, is blanked in response to a blanking signal generated by tuner control unit 9 and coupled to video processing unit 13, as will also be explained in detail below. When a new channel has been reliably tuned, the blanking signal is terminated by tuner control unit 9. However, the channel number and time of day continues to be displayed for short time thereafter. During this time, the on-screen characters are surrounded by the picture produced in response to the video signal.

Since the portions of the television receiver so far described are conventional and can be found in commercially available television receivers, no further detail as to these aspects need be described. By way of example, RCA television receivers of the CTC-131 chassis type, described in "RCA Color Television Basic Service Data - CTC-131 Series", file 1984, CTC-131, second edition, published by RCA Corporation, Indianapolis, Ind., contain portions corresponding to those portions of the television receiver shown in FIG. 1*a* described above. Specifically, portions of the CTC-131 chassis corresponding to tuner control 9, clock unit 23, character generator 25 are contained on printed circuit assembly MSC027. A similar character generator to the one employed in the CTC-131 chassis and which is suitable for use as character generator 25 is described in the above-noted Beyers, Jr. patent. A substantial portion of the luminance/chrominance video signal processing circuitry of the CTC-131 chassis corresponding to luminance/chrominance video processing unit 13, including that pertaining to the processing of tri-state character signals, is contained within an integrated circuit designated U700. Similar tri-state character signal processing circuitry to that contained in the CTC-131 and which is suitable for use in the receiver shown in FIG. 1*a* is described in the above-noted patent to Shanley and Parker.

The remaining portion of FIG. 1*a* concerns the coupling of the character signals generated by character generator 25 in tri-state form and measures, according to an aspect of the invention, to minimize smearing of the trailing edging portion of the characters.

As shown in FIG. 1*b*, the white signal generated by character generator 25 comprises a pulse having a duration corresponding to the duration of the character itself without the edging. The black signal is a pulse having a duration corresponding to the duration of the character plus the edging. The white pulse is centered with respect to the black pulse by character generator 25 with the intent that the leading and trailing edging portions will have the same width when displayed. For the reasons discussed below this may not be the case.

The black and white signals are combined by a tri-state driver 27, constructed, e.g., as shown in FIG. 2, to form a tri-state character signal. When no character is to be displayed, the tri-state character signal has an inactive voltage level and, when a character is to be displayed, the tri-state character signal has a black-going (which in this example is positive-going) pulse portion above the inactive voltage level, followed by a white-going pulse portion below the inactive voltage level, followed by another black-going pulse portion corresponding to the leading black edging portion, the white body and the trailing black edging portion, respectively, of the character. The inactive voltage level corresponds to a high output impedance state of tri-state driver 27. Thus, the value of the inactive voltage level primarily depends on the circuit to which the output of tri-state driver is connected. FIG. 1*b* shows the nature of the tri-state character signal as influenced by the capacitive loading exhibited by the cabling between tri-state driver 27 to be discussed next.

The tri-state character signal produced by tri-state driver 27 is coupled through a shielded or coaxial cable 29 to a switching unit 31. Switching unit 31, under user control, allows either the character signal generated by tri-state driver 27 to be commonly applied to red, green and blue character signal inputs of video signal processing unit 13 or allows three separate red, green and blue tri-state character signals ($C_r$, $C_g$ and $C_b$) provided by an external source, such as a home computer, to be separately applied to the red, green and blue character signal inputs of video signal processing unit 13. The three outputs of switching unit 31 are coupled to the red, green and blue character signal inputs of video processing unit 13 through respective shielded cables 33, 35 and 37. Since the character signal provided by tri-state driver 27 is provided in common to all three character signal inputs of video processing unit 13, only white characters are produced. However, since the externally generated tri-state character signals are separately applied to respective character signal inputs of video processing unit 13, characters of any color, depending on the levels of the white-going portions of the respective signals may be produced. If desired, so that only white characters are produced in response to the externally generated character signals, the three outputs of switching unit 31 may be "jumpered" together.

The blanking signal generated by tuner control unit 9 during channel changes is amplified by a driver 39 and the resulting amplified blanking signal is coupled to video signal processing unit 13.

For cost saving reasons, character generator 25, tri-state driver 27 and blanking signal driver 39 are desirably incorporated in a single integrated circuit. By way of example, as indicated in FIG. 1*a*, tuner control unit 9, clock unit 23, character generator 25, tri-state character signal driver 27 and blanking signal driver 39, which may all comprise logic circuits of the same technology type, may be included in a single integrated circuit 41. To enable such an integrated circuit to be used in different types of television receiver/monitors, including those that process two separate black and white character signals rather than a single tri-state character signal containing both black and white signal components, it is desirable that separate black and white character signals be provided. To that end, in integrated circuit 41, the black pulse is coupled to driver 39 where it is combined with the blanking signal generated by tuner control unit 9, which for this example is considered to be a positive-going pulse to form a composite "blank/black" signal containing both blanking pulses and black pulses. Since the purpose of both the black and blank pulses is to cause the screen to go black, one signal theoretically will not interfere with the other with respect to the operation of video signal processing unit 13. However, in practice, it is desirable to low pass filter the blank/-black signal to remove the black pulses before application to the blanking input of video signal processing unit 13 to prevent character ghosts due to different signal path delays for the blank/black and tri-state character signals. A black signal is thus made available for use in a receiver/monitor requiring separate black and white character signals. A white signal may be simply derived from the tri-state character signal output of tri-state driver 27 by connecting the tri-state character signal output to a pull-up resistor which is connected at the other end to a source of positive supply voltage. In that case, the inactive level is "pulled-up" to the black level and the tri-state signal is converted to a bi-state white character signal.

Shielded cables 29, 33, 35 and 37, having their outer conductors coupled to signal ground, inhibit interference signals which may otherwise be radiated to their inner conductors from producing unwanted picture disturbances. Unfortunately, shielded cables 29, 33, 35 and 37 present a significant capacitive load to the output of tri-state driver 27 considering that tri-state driver 27, switching unit 31 and video signal processing unit 13 may be located in different portions of the television receiver/monitor which are far apart.

The capacitive load tends to increase the rise and fall times of the edges of the tri-state character signal, as shown in FIG. 1*b*, and therefore tends to smear the edges of the displayed character and edging portions. Since tri-state driver 27 drives the character signal to the black level of the leading edging portion from the inactive level, to the white level of the character portion from the black level, and then to the black level of the trailing edging portion from the white level, the degradation of the rise and fall times associated with these transitions can be compensated for by suitably increasing the drive currents. However, after the trailing black edging portion, the character signal is not driven to the inactive level from the black by tri-state driver but is rather allowed to decay to it with a time constant determined by the capacitive load presented by shielded cables 29, 33, 35 and 37 and the impedances of the circuits to which the center conductors of cables 33, 35 and 37 are coupled.

The input impedances at the character signal inputs of video signal processing unit 13 can be made relatively low. For example, the character signal input circuitry described in the Shanley II and Parker patent comprises NPN and PNP common base amplifiers, as is shown for one of the character signal inputs of video signal processing unit 13, which exhibit relatively low impedances to respective reference voltage sources (e.g., +2.1 volts for the NPN transistor and +1.1 volts for the PNP transistor). However, as noted earlier, it is often desirable to place current limiting resistors in series with the input terminals of an integrated circuit to protect the integrated circuit from high energy discharges or arcs associated with picture tube 17. Resistors 43, 45 and 47 connected in series with the character signal inputs of video signal processing unit 13 are provided for such purpose. Due to the capacitive loading exhibited by shielded cables 29, 33, 35 and 37 and the resistance (e.g., 300 ohms) of current limiting resistors 43, 45 and 47, the decay time from the black level of the trailing edging portion of the character signal to the inactive level can be appreciable as is indicated by the portion of the character signal waveform of FIG. 1*b*drawn in phantom. The relatively long decay time causes the leading and trailing black edging portions of the displayed character to have different durations which may be very distracting to a viewer.

According to an aspect of the invention, an auxiliary driver circuit 49 is coupled to the output of tri-state driver 27, to drive the character signal from the black level of the trailing edging portion toward the inactive voltage level in response to the trailing edge of the black signal which occurs currently with the end of the trailing black edging portion. Specifically, auxiliary driver 49 includes a diode 51 and a capacitor 53 connected in series between the output of tri-state driver 27 and the output of blank/black driver 39 and a diode 55 is connected between the junction of diode 51 and capacitor 53 and a source of supply voltage $+V_{cc}$ which is also the supply voltage for drivers 27 and 39. Essentially, when the black pulse ends at the end of the trailing black edging portion associated with a character, the resulting transition to a low voltage produced at the blank/black signal acts as an auxiliary drive signal which causes auxiliary driver 49 to drive tri-state character signal from the black level toward the inactive level. As a result, the capacitive load presented by shielded cables 29, 33, 35 and 37 is rapidly discharged from the black level toward the inactive level as indicated by the solid line portion of the tri-state character signal shown in FIG. 1*a*. This tends to equalize the durations of the leading and trailing edging portions of the displayed character.

More specifically, auxiliary driver 49 works in the following way. Under steady state conditions, the character signal is at the inactive voltage level (e.g., +1.6 volts established by the common base amplifiers at the character signal inputs of video signal processing unit 13) and the black signal is at the low voltage level (e.g., near ground potential). Under these conditions, capacitor 53 charges to a voltage (with the polarity as indicated) equal to the inactive voltage level minus the forward voltage drop of diode 51 (e.g., +1.6 volts −0.6 volts=+1 volt). Diodes 51 and 55 are back-biased. At time $t_1$, both the tri-state character signal and the black signal rise rapidly toward $+V_{cc}$ (e.g., +5 volts). As a result, the junction between diodes 51 and 55 is clamped to $+V_{cc}$ plus the forward voltage drop of diode 55 and diode 51 is back-biased. At time $t_2$, diode 51 becomes even more back-biased. Between times $t_3$ and $t_4$ diode 51 remains back-biased. During the interval between times $t_1$ and $t_4$ capacitor 53 tends to discharge slightly toward the forward voltage drop across diode 55 (e.g., +0.6 volts) but does not reach it because of the long time constant of the circuit (e.g., capacitor 53 has a valve of 0.01 microfarads). At time $t_4$, the black signal rapidly drops to the low voltage level (e.g., near ground), causing the voltage at the junction of diodes 51 and 55 to drop correspondingly, and diode 51 turns on and diode 55 turns off. At this point in time, the voltage across capacitor 53 is slightly lower than its steady state value (e.g., +1 volt) and therefore the voltage across the series combination of forward-biased diode 51 and capacitor 53 is near the inactive voltage level (e.g., +1.6 volts). Thereafter the voltage across the capacitive load presented by shielded cables 29, 33, 35 and 37 continues to discharge toward the inactive level (e.g., +1.6 volts).

It has been found that the auxiliary driving arrangement is not dependent on the value of the capacitive load and therefore need not be modified for different receiver/monitor models with different cabling configurations.

A clamping diode 57 is connected between the tri-state character signal output of tri-state driver 27 and signal ground to protect the output of tri-state driver 27 from negative-going transients produced, for example, in response to picture tube discharges or arcing. Diodes 51 and 55, which are connected between the tri-state character signal output of tri-state driver 27 and the source of positive supply voltage $+V_{cc}$, advantageously act in a similar fashion to clamping diode 57 to protect driver 27 from positive-going transients.

A circuit implementation of tri-state driver 27 is shown in FIG. 2. The implementation comprises two N-channel field effect transistors 59 and 61 and control logic 63, responsive to the black and white signals generated by character generator 25, for tuning transistor 59 on and transistor 61 off during the black edging portions and transistor 61 on and transistor 59 off during the white character portions and both transistors 59 and 61 off during the inactive state.

A circuit implementation of blank/black signal driver 39 is shown in FIG. 3. The implementation includes two N-channel field effect transistors 65 and 67 and control logic 69, responsive to the black and blanking signals, for tuning transistor 65 on and transistor 67 off during the active states of the black and blanking signals and transistor 67 on and transistor 65 off during the inactive states of both of the black and blanking signals. For extra drive capability a pull-up resistor may be connected between the source of $+V_{cc}$ and the junction of the conduction paths of transistors 65 and 67.

While the present invention has been described in terms of a specific type of tri-state character signal for producing on-screen characters with edging portions, it may be employed with other types of tri-state signals. For example, it may be employed in an on-screen display arrangement for producing characters in a black surround area. These and other modifications are contemplated to be within the scope of the invention defined in the following claims.

What is claimed is:

1. On-screen display apparatus, comprising:

character generating means for generating a tri-state character signal at an output point including first driving means coupled to said output point for selectively driving said character signal to a first voltage level when enabled, second driven means coupled to said output point for selectively driving said character signal to a second voltage level when enabled, and control means for selectively enabling and disabling said first and second driving means, said character signal being allowed to exhibit a third level when said first and second driving means are disabled by said control means;

image producing means for generating an image in response to received signals;

coupling means coupled between said output point of said character generating means and said image producing means for coupling said character signal to said image producing means;

auxiliary driving means coupled to said coupling means for driving said character signal toward said third level from said first level when an auxiliary signal occurs; and auxiliary signal generating means for generating said auxiliary signal when both of said first and second driving means have been disabled by said control means;

said auxiliary signal generating means including pulse generating means for generating a pulse having a transition when both of said first and second driving means have been disabled, said transition comprising said auxiliary signal;

said auxiliary driving means including a capacitive device and a unidirectional conduction device coupled in series between said coupling means and said auxiliary signal generating means so that said unidirectional conduction device is rendered conductive when said transition of said pulse occurs.

2. The on-screen display apparatus recited in claim 1, wherein:

said auxiliary driving means temporarily couples a fourth voltage level having a magnitude near the magnitude of said third level to said coupling means in response to said auxiliary signal.

3. The on-screen display apparatus recited in claim 2, wherein:

said unidirectional conduction device comprises a first diode element;

a second diode element is coupled in series with said first diode element with the same conduction direction between said coupling means and a source of a first reference voltage; and a third diode element is coupled between said coupling means and a source of a second reference voltage with a conduction direction opposite to that of said first and second diode elements with respect to said coupling means.

4. The on-screen display apparatus recited in claim 3, wherein:

said transition of said pulse is substantially from said first reference voltage to said second reference voltage.

5. The on-screen display apparatus recited in claim 1, wherein:

said character signal includes a first portion at said first voltage level, a second portion at said second voltage level, and a third portion at said first voltage level; and said pulse signal encompasses said first, second and third portions of said character signal and has a first transition corresponding to the beginning of said first portion of said character signal and a second transition corresponding to the end of said third portion of said character signal, said second transition corresponding to said aforementioned transition comprising said auxiliary signal.

6. The on-screen display apparatus recited in claim 1, wherein:

said coupling means includes a shielded cable.

7. The on-screen display apparatus recited in claim 6, wherein:

said coupling means further includes a current limiting resistance element coupled between said shielded cable and said image producing means.

8. On-screen display apparatus, comprising:

character generating means for generating at an output a tri-state character signal having first and second active voltage levels corresponding to a body portion and a border portion, respectively, of a character when said character is to be displayed and an inactive voltage level when a character is not to be displayed;

auxiliary signal generating means for generating at an output a pulse signal having a transition corresponding to a desired end of a display character; and auxiliary driving means coupled to said output of said character generating means for driving said character signal toward said inactive voltage level from said first voltage level in response to said transition of said pulse signal;

said auxiliary driving means including a capacitive device and a unidirectional conduction device coupled in series between said outputs of said character signal generating means and said auxiliary signal generating means so that said unidirectional conduction device is rendered conductive in response to said transition of said pulse signal.

9. On-screen display apparatus, comprising:

character generating means for generating a tri-state character signal at an output point including first driving means coupled to said output point for selectively driving said character signal to a first voltage level when enabled, second driving means coupled to said output point for selectively driving said character signal to a second voltage level when enabled, and control means for selectively enabling and disabling said first and second driving means, said character signal being allowed to exhibit a third level when said first and second driving means are disabled by said control means;

image producing means for generating an image in response to received signals;

coupling means coupled between said output point of said character generating means and said image producing means for coupling said character signal to said image producing means;

auxiliary signal generating means for generating an auxiliary pulse signal having a first level when both of said first and second driving means are disabled by said control means and a second level when either one of first and second driving means are enabled by said control means; and auxiliary driving means coupled to said coupling means for driving said character signal toward said third level from said first level by coupling a fourth voltage level having a magnitude near said third level to said coupling means when a transition of said auxiliary pulse signal from said second level to said first level occurs;

said auxiliary driving means including a capacitive device, and selectively enabled conduction means for selectively coupling said capacitive device to said coupling means so that said capacitive device is coupled to said coupling means during the occurrence of said first level to be charged toward said third level from said coupling means, is decoupled from said coupling means during the occurrence of said second level, and is again coupled to said coupling means when said transition of said auxiliary pulse signal from said second level to said first level occurs.

10. The on-screen display apparatus recited in claim 9, wherein:

said conduction device comprises a first diode element;

a second diode element is coupled in series with said first diode element with the same conduction direction between said coupling means and a source of a first reference voltage; and a third diode element is coupled between said coupling means and a source of a second reference voltage with a conduction direction opposite to that of said first and second diode elements with respect to said coupling means.

11. The on-screen display apparatus recited in claim 10, wherein:

said transition of said auxiliary pulse is substantially from said first reference voltage to said second reference voltage.

12. The on-screen display apparatus recited in claim 9, wherein:

said character signal includes a first portion at said first voltage level, a second portion at said second voltage level, and a third portion at said first voltage level; and said auxiliary pulse signal encompasses said first, second and third portions of said character signal, said first transition corresponding to the beginning of said first portion of said character signal, said second transition corresponding to the end of said third portion of said character signal.

13. The on-screen display apparatus recited in claim 9, wherein:

said coupling means includes a shielded cable.

14. The on-screen display apparatus recited in claim 13, wherein:

said coupling means further includes a current limiting resistance element coupled between said shielded cable and said image producing means.

15. On-screen display apparatus, comprising:

character generating means for generating at an output a tri-state character signal having first and second active voltage levels corresponding to a body portion and a border portion, respectively, of a character when said character is to be displayed and an inactive voltage level when a character is not to be displayed;

auxiliary signal generating means for generating at an output a pulse signal having a first transition corresponding to the beginning of a displayed character and a second transition corresponding to a desired end of said displayed character; and auxiliary driving means coupled to said output of said character generating means for driving said character signal toward said inactive voltage level from said first voltage level when said second transition of said pulse signal occurs;

said auxiliary driving means including a capacitive device and selectively enabled conduction means for selectively coupling said capacitive device to said output of said character signal generating means in response to said pulse signal so that said capacitive device is coupled to said output of said character signal generating means prior to said first transition of said pulse signal to charge said capacitive device toward said inactive voltage level developed at said output when no character is displayed, is decoupled from said output between said first and second transitions so that said capacitive device substantially stores the voltage to which it was charged prior to said first transition when a character is displayed, and is again coupled to said output when said second transition occurs to apply the voltage stored by said capactive device between said first and second transitions to said output when said character ends.

* * * * *

UNITED STATES PATENT AND TRADEMARK OFFICE
CERTIFICATE OF CORRECTION

PATENT NO. : 4,760,391

DATED : July 26, 1988

INVENTOR(S) : Robert Joseph Gries

It is certified that error appears in the above-identified patent and that said Letters Patent is hereby corrected as shown below:

Column 7, line 14, "FIG. 1a" should be -- FIG. 1b --.

Signed and Sealed this

Third Day of January, 1989

*Attest:*

DONALD J. QUIGG

*Attesting Officer*

*Commissioner of Patents and Trademarks*